US011112173B2

(12) United States Patent
Mak

(10) Patent No.: US 11,112,173 B2
(45) Date of Patent: Sep. 7, 2021

(54) CONFIGURATIONS AND METHODS FOR SMALL SCALE LNG PRODUCTION

(71) Applicant: Fluor Technologies Corporation, Sugar Land, TX (US)

(72) Inventor: John Mak, Santa Ana, CA (US)

(73) Assignee: Fluor Technologies Corporation, Irving, TX (US)

( * ) Notice: Subject to any disclaimer, the term of this patent is extended or adjusted under 35 U.S.C. 154(b) by 279 days.

(21) Appl. No.: 15/201,070

(22) Filed: Jul. 1, 2016

(65) Prior Publication Data

US 2018/0003429 A1 Jan. 4, 2018

(51) Int. Cl.

| | |
|---|---|
| ***F25J 1/00*** | (2006.01) |
| ***F25J 5/00*** | (2006.01) |
| ***F25J 1/02*** | (2006.01) |

(52) U.S. Cl.

CPC ..... *F25J 1/0022* (2013.01); *F25J 1/004* (2013.01); *F25J 1/005* (2013.01); *F25J 1/0052* (2013.01); *F25J 1/0072* (2013.01); *F25J 1/0208* (2013.01); *F25J 1/0245* (2013.01); *F25J 1/0288* (2013.01); *F25J 5/00* (2013.01); *F25J 2210/60* (2013.01); *F25J 2220/66* (2013.01);

(Continued)

(58) Field of Classification Search

CPC ..... F25J 1/0022; F25J 1/0047; F25J 1/0052; F25J 1/0057; F25J 5/00; F25J 1/005; F25J 1/0204; F25J 1/0212; F25J 1/0254; F25B 9/06

See application file for complete search history.

(56) References Cited

U.S. PATENT DOCUMENTS

| | | | |
|---|---|---|---|
| 2,806,688 | A | 9/1957 | Max et al. |
| 3,690,115 | A | 9/1972 | Clayton et al. |

(Continued)

FOREIGN PATENT DOCUMENTS

| | | |
|---|---|---|
| AU | 2011282529 A1 | 2/2013 |
| BR | 1120180773263 | 1/2019 |

(Continued)

OTHER PUBLICATIONS

International Application No. PCT/US2016/040954, International Search Report, dated Mar. 14, 2017, 3 pages.

(Continued)

*Primary Examiner* — Frantz F Jules
*Assistant Examiner* — Webeshet Mengesha
(74) *Attorney, Agent, or Firm* — Conley Rose, PC

(57) ABSTRACT

An LNG plant comprises a cold box and a refrigeration unit fluidly coupled with a plurality of heat exchanger passes in the cold box. The refrigeration unit is configured to provide a first refrigerant stream to a first heat exchanger pass of the plurality of heat exchanger passes at a first pressure, a second refrigerant stream to a second heat exchanger pass at a second pressure, and a third refrigerant stream to a third heat exchanger pass at a third pressure. The second refrigerant stream comprises a first portion of the first refrigerant stream, and the third refrigerant stream comprises a second portion of the first refrigerant stream. The second pressure and the third pressure are both below the first pressure. The cold box is configured to produce LNG from a natural gas feed stream to the cold box using a refrigeration content from the refrigeration unit.

12 Claims, 3 Drawing Sheets

(52) U.S. Cl.
CPC ..... *F25J 2220/68* (2013.01); *F25J 2230/60* (2013.01); *F25J 2240/40* (2013.01); *F25J 2245/90* (2013.01); *F25J 2270/16* (2013.01); *F25J 2290/12* (2013.01); *F25J 2290/62* (2013.01)

(56) References Cited

U.S. PATENT DOCUMENTS

| | | | | |
|---|---|---|---|---|
| 3,792,590 | A | 2/1974 | Lofredo et al. | |
| 3,797,514 | A | 3/1974 | Byers et al. | |
| 5,036,671 | A | 8/1991 | Nelson et al. | |
| 5,322,092 | A | 6/1994 | Howeth et al. | |
| 5,363,655 | A | 11/1994 | Kikkawa et al. | |
| 5,755,114 | A | 5/1998 | Foglietta | |
| 6,237,347 | B1 | 5/2001 | Rigby et al. | |
| 7,493,778 | B2 | 2/2009 | Engdahl | |
| 7,673,476 | B2 | 3/2010 | Whitesell | |
| 7,690,365 | B2 | 4/2010 | Lee et al. | |
| 7,921,656 | B2 | 4/2011 | Mostello | |
| 8,950,196 | B2 | 2/2015 | Mak | |
| 9,829,244 | B2 | 11/2017 | Mak | |
| 2006/0053806 | A1 | 3/2006 | Tassel | |
| 2007/0256450 | A1 | 11/2007 | Mostello | |
| 2008/0034769 | A1 | 2/2008 | Engdahl | |
| 2009/0277219 | A1 | 11/2009 | Mak et al. | |
| 2010/0139317 | A1 | 6/2010 | Chantant et al. | |
| 2010/0146971 | A1 | 6/2010 | Mak | |
| 2010/0186445 | A1* | 7/2010 | Minta | F25J 1/0022 62/606 |
| 2011/0056238 | A1 | 3/2011 | Mak | |
| 2011/0203312 | A1* | 8/2011 | Jakobsen | F25J 1/0022 62/613 |
| 2013/0008204 | A1* | 1/2013 | Kim | F25J 1/0012 62/600 |
| 2013/0192297 | A1* | 8/2013 | Mak | F25J 1/0022 62/613 |
| 2013/0340475 | A1 | 12/2013 | Turner et al. | |
| 2014/0116084 | A1* | 5/2014 | Bonnissel | F25B 9/06 62/611 |
| 2014/0190205 | A1* | 7/2014 | Bonnissel | F25J 1/0022 62/614 |
| 2014/0245780 | A1* | 9/2014 | Wyllie | F25J 1/0022 62/613 |
| 2014/0260415 | A1 | 9/2014 | Ducote, Jr. et al. | |
| 2015/0300731 | A1* | 10/2015 | Agarwal | F25J 1/0022 62/613 |
| 2018/0003429 | A1 | 1/2018 | Mak | |
| 2018/0058753 | A1 | 3/2018 | Mak et al. | |
| 2020/0104697 | A1 | 4/2020 | Bhatia et al. | |

FOREIGN PATENT DOCUMENTS

| | | | |
|---|---|---|---|
| CA | 2806688 | A1 | 2/2012 |
| CA | 3027483 | A1 | 12/2018 |
| CN | ZL201180046944.7 | | 3/2016 |
| CN | 109661535 | A | 4/2019 |
| EP | 2598816 | A1 | 6/2013 |
| WO | WO199859205 | | 12/1998 |
| WO | WO2006118458 | A2 | 11/2006 |
| WO | WO2009006693 | A1 | 1/2009 |
| WO | WO2009006695 | A1 | 1/2009 |
| WO | WO2009057179 | A2 | 5/2009 |
| WO | WO2009126604 | A1 | 10/2009 |
| WO | 2012016166 | A1 | 2/2012 |
| WO | 2018004701 | A1 | 1/2018 |
| ZA | 201300736 | B | 11/2015 |

OTHER PUBLICATIONS

International Application No. PCT/US2016/040954, Written Opinion of the International Searching Authority dated Mar. 14, 2017, 7 pages.
Office Action dated Sep. 15, 2015, filed Apr. 8, 2013, U.S. Appl. No. 13/813,036.
Final Office Action dated Mar. 28, 2016, filed Apr. 8, 2013, U.S. Appl. No. 13/813,036.
Advisory Action dated Jun. 3, 2016, filed Apr. 8, 2013, U.S. Appl. No. 13/813,036.
Notice of Allowance dated Jun. 16, 2017, filed Apr. 8, 2013, U.S. Appl. No. 13/813,036.
Notice of Allowance dated Jul. 14, 2017, filed Apr. 8, 2013, U.S. Appl. No. 13/813,036.
Examination Report dated Jul. 22, 2013, Australia Application No. 2011282529.
Notice of Acceptance dated Nov. 8, 2013, Australia Application No. 2011282529.
Partial Search Report dated, Oct. 26, 2016, Europe Application No. 11813263.8.
Extended Search Report dated, Mar. 17, 2017, Europe Application No. 11813263.8.
Office Action dated Jan. 9, 2014, Canada Application No. 2806688.
Notice of Allowance dated Nov. 26, 2014, Canada Application No. 2806688.
Office Action dated Dec. 11, 2014, Eurasia Application No. 201390187.
Office Action dated Dec. 10, 2015, Eurasia Application No. 201390187.
Notice of Allowance dated Jun. 18, 2016, Eurasia Application No. 201390187.
Office Action dated Oct. 20, 2014, China Application No. 201180046944.7.
Office Action dated Jun. 30, 2015, China Application No. 201180046944.7.
Notification to Grant Patent Right dated Dec. 4, 2015, China Application No. 201180046944.7.
International Search Report and Written Opinion dated Jan. 9, 2012, PCT/US2011/045937, filed on Jul. 29, 2010.
International Preliminary Report on Patentability dated Jan. 29, 2013, PCT/US2011/045937, filed on Jul. 29, 2010.
Nalther, S. et al. "Liquefaction solutions for challenge of offshore FPSO developments", LNG Journal, Nelton Publications, Gravesend, GB, vol. 39, dated Feb. 1, 2008, pp. 31-34.
Mak, John, "Configurations and Methods for Small Scale LNG Production," U.S. Appl. No. 61/368,900, filed Jul. 29, 2010.
International Preliminary Report on Patentability dated Jan. 10, 2019, PCT/US2016/040954, filed on Jul. 5, 2016.
Office Action dated Jun. 10, 2020, Chinese Patent Application No. 201680087367.9 filed Jul. 5, 2016.
Bowen, M.A., "Clean Fuel Production Technology", China Petrochemical Press, Feb. 2001, pp. 240-241.
Office Action dated Feb. 1, 2021, Chinese Patent Application No. 201680087367.9 filed Jul. 5, 2016.
Preliminary Opinion published Aug. 11, 2020, Brazilian Patent Application No. 112018 077326-3, filed Jul. 5, 2016.

* cited by examiner

CONFIGURATIONS AND METHODS FOR SMALL SCALE LNG PRODUCTION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Natural gas supply in North America is continually growing, mostly due to the production of new shale gas, recent discoveries of offshore gas fields, and to a lesser extent, stranded natural gas brought to market after construction of the Alaska natural gas pipeline, and it is believed that shale gas and coal-bed methane will make up the majority of the future growth in the energy market.

While natural gas supply is increasing, crude oil supply is depleting as there are no significant new discoveries of oil reserves. If this trend continues, transportation fuel derived from crude oil will soon become cost prohibitive, and alternate renewable fuels (and particularly transportation fuels) are needed. Moreover, since combustion of natural gas also produces significantly less CO2 as compared to other fossil materials (e.g., coal or gasoline), use of natural gas is even more desirable. Natural gas used for transportation fuel must be in a denser form, either as CNG (compressed natural gas) or LNG (liquefied natural gas). CNG is produced by compression of natural gas to very high pressures of about 3000 to 4000 psig. However, even at such pressures, the density of CNG is relatively low, and storage at high pressure requires heavy weight vessels and is potentially a hazard. On the other hand, LNG has a significantly higher density and can be stored at relatively low pressures of about 20 to 150 psig. Still further, LNG is a safer fuel than CNG, as it is at lower pressure and not combustible until it is vaporized and mixed with air in the proper ratio. Nevertheless, CNG is more common than LNG as a transportation fuel, mainly due to the cost of high liquefaction and the lack of infrastructure to support LNG fueling facilities.

LNG can be used to replace diesel and is presently used in many heavy duty vehicles, including refuse haulers, grocery delivery trucks, transit buses, and coal miner lifters. To increase the LNG fuel markets, small to mid-scale LNG plants must be constructed close to both pipelines and LNG consumers, as long distance transfer of LNG is costly and therefore often not economical. Such small to mid-scale LNG plants should be designed to produce 0.2 mtpy to 2.0 mtpy (million tonnes per year). Moreover, such small to mid-scale LNG plants must be simple in design, easy to operate, and sufficiently robust to support an unmanned operation. Still further, it would be desirable to integrate liquefaction with LNG truck fueling operations to allow for even greater delivery flexibility.

Various refrigeration processes are used for LNG liquefaction. The most common of these refrigeration processes are the cascade process, the mixed refrigerant process, and the propane pre-cooled mixed refrigerant process. While these methods are energy efficient, such methods are often complex and require circulating several hydrocarbon refrigerants or mixed hydrocarbon refrigerants. Unfortunately, such refrigerants (e.g., propane, ethylene, and propylene) are explosive and hazardous in the event of leakage.

There are several recent innovations in LNG plant design. For example, U.S. Pat. No. 5,755,114 to Foglietta teaches a hybrid liquefaction cycle which includes a closed loop propane refrigeration cycle and a turboexpander cycle. Compared to other liquefaction processes, the liquefaction process has been simplified, but is still unsuitable and/or economically unattractive for small to mid-scale LNG plants. U.S. Pat. No. 7,673,476 to Whitesell discloses a compact and modular liquefaction system that requires no external refrigeration. The system uses gas expansion by recycling feed gas to generate cooling. While this design is relatively compact, operation of the recycle system is complicated, and the use of hydrocarbon gas for cooling remains a safety concern. U.S. Pat. No. 5,363,655 to Kikkawa teaches the use of gas expander and plate and fin heat exchangers for LNG liquefaction. While providing several advantages, such process is still too complex and costly for small to mid-scale LNG plants.

Further compounding the above noted drawbacks is the fact that most of the systems lack the capability for integration of a small to mid-scale LNG plant with an LNG loading operation. Thus, the current practice for loading an LNG truck generally requires an LNG pump to pump the LNG from the storage tanks to the LNG trucks. Remarkably, the boil-off vapors generated during the LNG truck loading operation are vented to the atmosphere which is a safety hazard and creates emission pollution.

Thus, various disadvantages remain. Among other things, most of the LNG liquefaction methods and configurations are complex and costly and hence unsuitable for the small to mid-scale LNG plants. In addition, most liquefaction plants lack an integrated system for LNG loading operations, which is highly desirable for small to mid-scale LNG plants.

SUMMARY

In an embodiment, an LNG plant comprises a cold box comprising a plurality of heat exchanger passes and a refrigeration unit comprising a closed refrigeration cycle. The cold box is fluidly coupled with the refrigeration unit, and the cold box is configured to receive a natural gas feed stream and produce LNG from the feed stream using a refrigeration content from the refrigeration unit. The refrigeration unit comprises a first compressor unit configured to compress a refrigerant to produce a compressed refrigerant at a first pressure, a first heat exchanger pass of the plurality of heat exchanger passes that is configured to pass the compressed refrigerant through the cold box to cool the compressed refrigerant, a splitter configured to separate the cooled, compressed refrigerant into a first portion and a second portion, a first expander configured to receive the first portion from the splitter and expand the first portion to a second pressure, a second expander configured to receive the second portion from the splitter and expand the second portion to a third pressure, a second heat exchanger pass of the plurality of heat exchanger passes configured to pass the first portion at the second pressure through the cold box, a third heat exchanger pass of the plurality of heat exchanger passes configured to pass the second portion at the third pressure through the cold box to provide at least a portion of the refrigeration content in the cold box, at least one second compressor that is configured to receive the second portion downstream of the third heat exchanger pass and compress the second portion to the second pressure, and a mixer that is configured to combine the compressed second portion downstream of the at least one second compressor and the first portion downstream of the second heat exchanger pass to form the refrigerant upstream of the first compressor. The second pressure is less than the first pressure, and the third pressure is less than the second pressure.

In an embodiment, an LNG plant comprises a cold box comprising a heat exchanger that has a plurality of heat exchanger passes and a refrigeration unit fluidly coupled with the plurality of heat exchanger passes. The refrigeration unit is configured to provide a first refrigerant stream to a first heat exchanger pass of the plurality of heat exchanger passes at a first pressure, a second refrigerant stream to a second heat exchanger pass of the plurality of heat exchanger passes, and a third refrigerant stream to a third heat exchanger pass of the plurality of heat exchanger passes. The second refrigerant stream comprises a first portion of the first refrigerant stream downstream of the first heat exchanger pass, and the second refrigerant stream is at a second pressure. The third refrigerant stream comprises a second portion of the first refrigerant stream downstream of the first heat exchanger pass, and the third refrigerant stream is at a third pressure. The second pressure and the third pressure are both below the first pressure. The cold box is configured to receive a natural gas feed stream and produce LNG from the natural gas feed stream using a refrigeration content from the refrigeration unit in the plurality of heat exchanger passes.

In an embodiment, a method of generating LNG from a natural gas feed comprises passing a first refrigerant stream through a first heat exchanger pass of a plurality of heat exchanger passes in a cold box at a first pressure, separating the first refrigerant stream into a second refrigerant stream and a third refrigerant stream downstream of the cold box, passing the second refrigerant stream through a second heat exchanger pass of the plurality of heat exchanger passes at a second pressure, passing the third refrigerant stream through a third heat exchanger pass of the plurality of heat exchanger passes, passing a natural gas feed stream through at least a fourth heat exchanger pass of the plurality of heat exchanger passes, and liquefying at least a portion of the natural gas stream in the cold box using a refrigeration content provided by at least one of the second refrigerant stream or the third refrigerant stream to form an LNG stream. The third refrigerant stream is at a third pressure, and the second pressure and the third pressure are both below the first pressure.

Various objects, features, aspects and advantages will become more apparent from the following detailed description of various embodiments along with the accompanying drawings.

DETAILED DESCRIPTION

Figure 1:
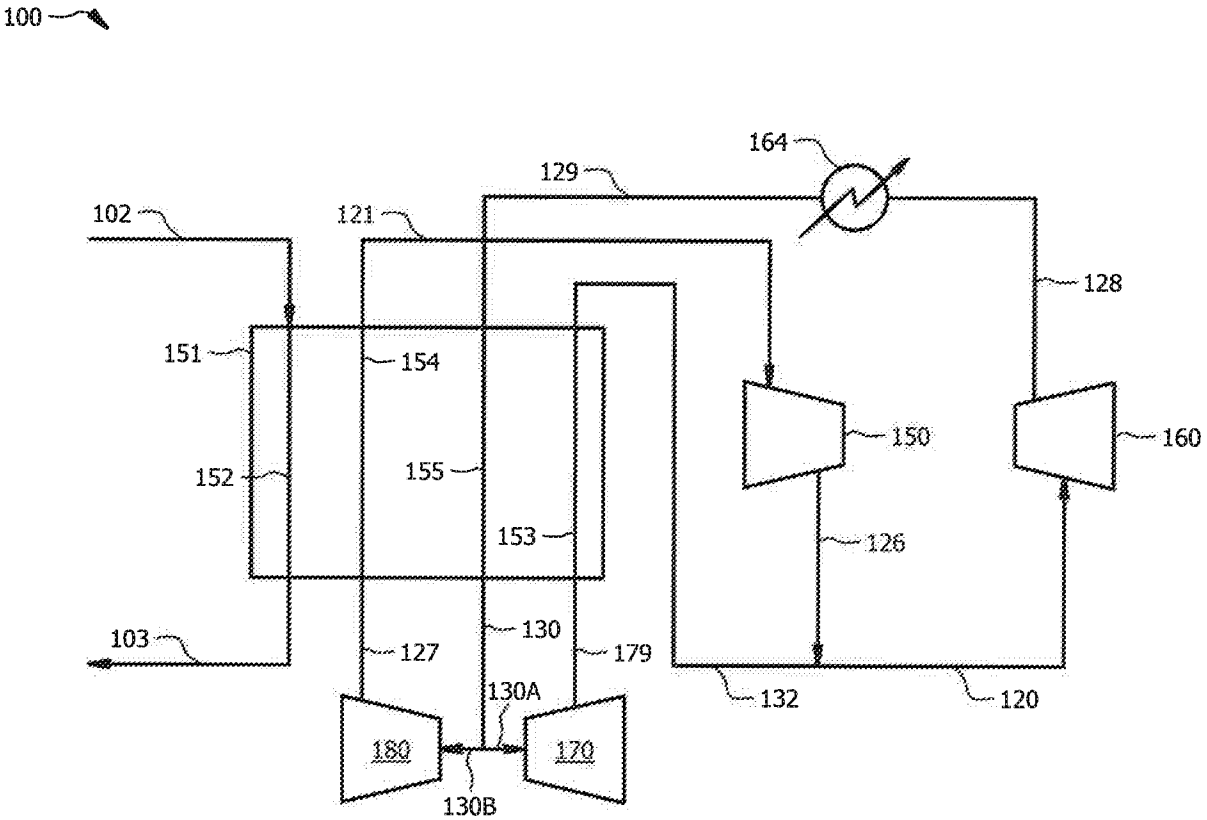
FIG. 1 is one exemplary configuration according to an embodiment using a nitrogen cycle.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about," "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

The systems and methods described herein are directed to natural gas liquefaction and LNG (liquefied natural gas) truck loading, and especially use of gas expansion processes for small to mid-scale LNG plants and integration of natural gas liquefaction with an LNG truck loading facility. As described herein, a small to mid-scale LNG plant can be integrated with an LNG truck loading facility in a simple and cost-effective manner. In some aspects, the small to mid-scale LNG plant can have a capacity of typically about 0.2 mtpy to about 0.7 mtpy, typically between about 0.7 mtpy to about 1.5 mtpy, and most typically between about 1.5 mtpy to about 2.5 mtpy of LNG by liquefaction of appropriate quantities of feed gas. For some applications, the contemplated process may also be suitable for producing LNG below about 0.1 mtpy. In further aspects, the refrigeration process uses a non-hydrocarbon refrigerant (e.g., nitrogen, air, etc.) in a compression expansion cycle to so avoid the safety issues commonly associated with a hydrocarbon refrigeration system.

As disclosed herein, natural gas (e.g., delivered from a pipeline) can be liquefied in a cold box using a gas expansion cycle that employs a two-stage compressor to so produce at least two pressure level gases. The so produced gases are then cooled and expanded to a lower pressure to thereby generate refrigeration prior to mixing in a heat exchanger as a single gas stream that is then fed to the compressors that are driven by the expanders.

The expander cycle can use nitrogen that is inherently safe to operate and more reliable than conventional mixed refrigerant processes while the nitrogen expander cycle can be of low pressure or high pressure design to match the feed gas composition and pressure with power consumption per unit of LNG produced of about 320 to about 425 kW/ton.

In some embodiments, the LNG loading facility has a pressure control system that uses high pressure feed gas as a motive force to move the LNG product from an LNG storage tank to an LNG truck while boil-off vapors from the LNG truck are recovered in the liquefaction plant.

In one aspect, a small to mid-scale LNG plant can have an integrated loading terminal, wherein the plant includes a cold box with a closed refrigeration cycle (preferably a two stage expander refrigeration system, operating with a non-hydrocarbon refrigerant) to so provide refrigeration content to a natural gas feed at a temperature sufficient to produce LNG from the natural gas feed. It is generally preferred that an LNG storage tank is thermally coupled to the refrigeration cycle to receive and store the LNG, and that a first boil off vapor line provides a first boil off vapor from an LNG transporter to the cold box, and from the cold box to the LNG storage tank, while a second boil off vapor line provides a second boil off vapor from the LNG storage tank to the cold box, and from the cold box to the natural gas feed. Most typically, a compressor compresses at least one of the first and second boil off vapors, and/or a differential pressure controller maintains a predetermined pressure differential (e.g., 5-200 psi, more typically 10-50 psi) between the LNG storage tank and the LNG transporter.

In another aspect, LNG from the storage tank is unloaded from the top of the storage tank using an internal pipe in the storage tank, which eliminates the potential hazards of LNG spillage of the LNG tank inventory typically used in commonly used tank configurations.

Therefore, and viewed from a different perspective, a method of liquefying natural gas and loading the LNG to an LNG transporter will include a step of liquefying natural gas feed in a cold box using a closed refrigeration cycle, and feeding the LNG to an LNG storage tank. In another step, a first boil off vapor from an LNG transporter is cooled and compressed and used as a motive force to deliver LNG from the LNG storage tank to the LNG transporter. In such methods, a second boil off vapor from the LNG storage tank can be cooled and compressed and moved from the cold box to the natural gas feed. As before, the step of liquefying a natural gas feed can be performed using a two stage closed refrigeration cycle, typically using a non-hydrocarbon refrigerant, such as nitrogen.

FIG. 1 illustrates an embodiment of a LNG liquefaction system 100. Feed gas stream 102 can be supplied to the small scale LNG liquefaction plant. The feed gas stream can comprise primarily light hydrocarbons, such as methane and ethane. Minor amounts of various other gases, including inert gases such as nitrogen, argon and the like, can also be present. The feed gas stream can be treated in a gas treatment unit that typically includes an amine unit and a dehydration unit for removal of CO2 and water, forming a dry and substantially CO2 free gas stream. The feed gas stream may have a temperature of between about 50° F. and 200° F. and a pressure of between about 100 psia and 700 psia. The feed gas stream 102 can enter the cold box 151, which can comprise a plurality of heat exchanger passes 152, 153, 154, and 155. While four heat exchanger passes are shown in FIG. 1, more than four heat exchanger passes or less than four heat exchanger passes can also be used with the system 100. The feed gas can be chilled by nitrogen refrigeration in heat exchanger pass 152 and form a sub-cooled LNG stream 103, which can then be let down in pressure in a downstream JT valve forming a flashed LNG stream. The flashed vapor can be returned to the liquefaction unit and the resulting liquid LNG can be stored in a LNG storage tank, as described in more detail herein.

The refrigeration for the cold box 151 can be provided by the closed refrigeration cycle. As shown in FIG. 1, the closed refrigeration cycle can comprise a two-stage liquefaction cycle using a high-pressure refrigerant cycle, typically operating at pressures greater than about 1,000 psia. In the refrigeration cycle, stream 126 from compressor 150 can be discharged at a pressure between about 400 psia and 600 psia to feed the compressor unit 160, which compresses the refrigerant gas to greater than about 1,000 psia (e.g., greater than 1,100 psia, greater than 1,200 psia, or greater than 1,300 psia) to form stream 128. The compressor unit 160 may generally have an upper compression limit of around 1,500 psia, though the stream 126 may not be compressed to this limit in most configurations. The compressor unit 160 can comprise single-stage or multi-stage compressors, optionally with intercoolers. The compressor discharge can be cooled in cooler 164 to form stream 129, which can be further cooled in the cold box 151 in exchanger pass 155 to between −10° F. and about −50° F. forming stream 130. Stream 130 can be split into two portions: streams **130*a* and 130*b*. The molar ratio of the two streams can be divided into any suitable amounts, which can be based on the feed gas composition and/or the pressure. In some aspects, the two streams 130*a* and 130*b* can be split at a molar ratio of stream 130*a* to stream 130** of between about 0.5 and about 0.75, or between about 0.6 and about 0.7, or at about 0.68.

Stream **130*a* can be expanded in expander 170 to between about 20% and about 50%, or between about 30% and about 45%, or between about 35% and about 42% of the original pressure on an absolute pressure scale to form stream 179 that passes through heat exchanger pass 153. Stream 179 can cool the feed gas stream 102 and the high-pressure refrigerant stream 129 in the cold box 151. Stream 179 can pass out of the cold box 151 as stream 132. Stream 130*b* can be expanded in expander 180 to between about 3% and about 20%, or between about 4% and about 15%, or between about 5% and about 10%, or between about 7% and about 9% of the original pressure on an absolute pressure scale to form stream 127 that passes through heat exchanger pass 154. Stream 127 can be used to cool the feed gas and the high-pressure refrigerant in the cold box 151. Stream 127 can pass out of the cold box 151 as stream 121, which can then be compressed by compressor 150 to a pressure substantially the same as the pressure of stream 179, and stream 121 can then be mixed with stream 132 to form stream 120 as feed to the compressor 160**.

The use of two expanded refrigerant flow paths through the cold box 151 may allow for a more efficient cooling in some instances. In an embodiment, the two lower pressure streams passing through separate heat exchanger passes through the cold box 151 can have a relative pressure ratio of between about 10:1 and about 2:1, between about 7:1 and about 3:1, or between about 5:1 and about 4:1, each as a ratio of the higher pressure refrigerant stream 179 to lower pressure refrigerant stream 127 on an absolute pressure scale.

Thus, the closed refrigeration cycle can comprise a cold box having multiple heat exchanger passes, including a plurality of heat exchanger passes for the refrigerant and at least one heat exchanger pass for the natural gas feed stream. The refrigeration unit is fluid coupled to the cold box and the plurality of heat exchanger passes to provide the refrigerant and refrigeration content for forming LNG from the natural gas feed stream in the cold box. As shown in FIG. 1, the refrigeration unit is configured to provide at least a first refrigerant stream to a first heat exchanger pass of the plurality of heat exchanger passes. The first refrigerant stream can be at a first pressure, which can be a relatively high pressure after being compressed in compressor unit 160. The refrigeration unit is also configured to provide a second refrigerant stream to a second heat exchanger pass in the cold box. The second refrigerant stream can be a portion of the compressed refrigerant stream resulting from splitting the compressed refrigerant stream downstream of the first heat exchanger pass. The second refrigerant stream can be expanded (e.g., using an expander) such that the second refrigerant stream can be at a second pressure that is lower than the compressed pressure at the entrance to the second heat exchanger pass. The refrigeration unit can also provide a third refrigerant stream to a third heat exchanger pass. The third refrigerant stream can be the remaining portion of the compressed refrigerant stream resulting from splitting the compressed refrigerant stream downstream of the first heat exchanger pass. The third refrigerant stream can be expanded (e.g., using an expander) such that the third refrigerant stream is at a third pressure that is lower than the second pressure at the entrance to the third heat exchanger pass. The second and/or third heat exchanger passes can provide the refrigeration content within the cold box. The resulting refrigeration content can then be used to form the LNG from the natural gas in the natural gas feed stream with power consumption per unit of LNG produced of about 320 kW/ton to about 425 kW/ton.

Figure 2:
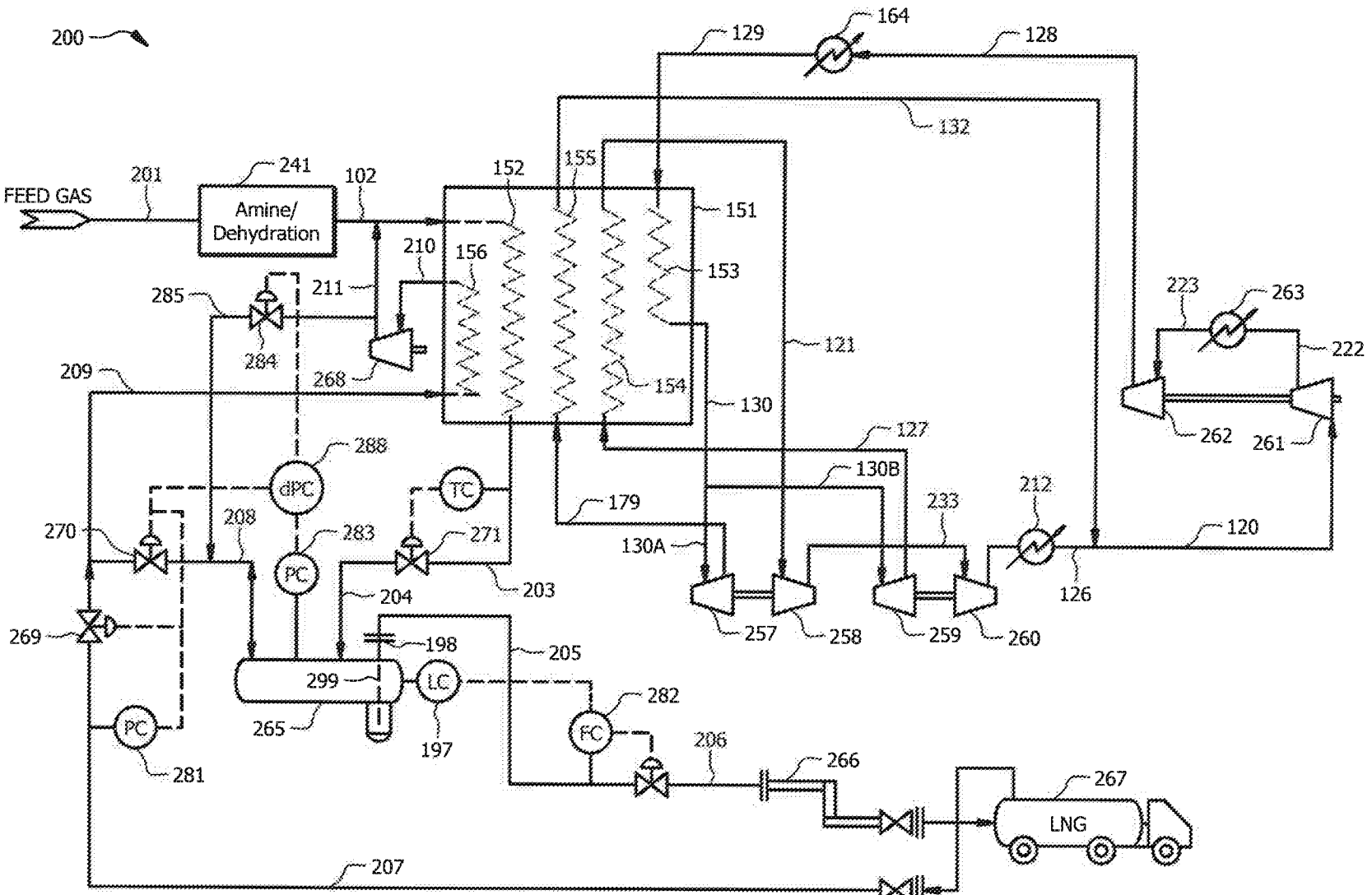
FIG. 2 is another exemplary configuration according to an embodiment using a nitrogen cycle with an integrated LNG loading.

FIG. 2 illustrates another embodiment of an LNG production system 200. The refrigeration unit of FIG. 2 is similar to the refrigeration unit of the system 100 illustrated in FIG. 1, and the differences will be described in more detail with reference to FIG. 2. In the system 200, the feed gas stream 201 can be supplied to the LNG liquefaction plant at any suitable flow rate, temperature, and pressure. The feed gas stream can be the same or similar to the feed gas stream 102 described with respect to FIG. 1, including the composition, pressure, and temperature. In an embodiment and as an example of suitable conditions, the feed gas stream 201 can be delivered at a flow rate of about 1.7 MMscfd, at a temperature of about 100° F., and at a pressure of about 453 psia. As a further example, the feed gas stream can have a composition comprising about 1.0 mol % $N_2$, about 0.1 mol % $CO_2$, about 96.5 mol % methane, about 2 mol % ethane, and about 0.5 mol % propane and heavier components. The feed gas can be treated in a gas treatment unit 241 that can include an amine unit and/or a dehydration unit (e.g., a molecular sieve dehydration unit) for the removal of $CO_2$ and water, forming a substantially dry and $CO_2$ free gas stream 202.

The dried gas stream 202 can be combined with a recycle gas stream 211, as described in more detail herein, and can enter the cold box 251, which typically comprises a plurality of heat exchanger passes, 152, 153, 154, 155, and 156. The feed gas 102 can be chilled by nitrogen refrigeration in heat exchanger pass 152 to form a sub-cooled stream 203 and can then be let down in pressure in Joule-Thomson valve 271 to form stream 204. As an example, the sub-cooled stream can be cooled to about −223° F., and the flashed liquid downstream of the JT valve 271 can be at about −227° F. The flashed liquid can be stored in storage tank 265, which can operate at a pressure above atmospheric, e.g., between about 20 psia and 100 psi, or at about 60 psia. The flashed gas stream 208 can be recovered by recycling the gas in stream 208 back to the exchanger pass 156 via valve 270. As the gas in stream 208 is in equilibrium with the liquid in the storage tank 265, the gas can have a temperature less than that of the other streams in the cold box 151. The refrigeration content of this recycle stream can be recovered in the cold box 151. Thus, it should be noted that the flashed stream from the storage tank 265 can be heated in the cold box 151. Once the gas stream passes through the cold box 151 to form stream 210, the stream 210 can exit the cold box 151 and be compressed by compressor 268 to a pressure at or above the feed gas pressure to form stream 211 prior to mixing with feed gas stream 102.

The two-stage nitrogen liquefaction cycle can also be configured using a high-pressure nitrogen cycle, typically operating at above 1,000 psia (e.g., at or above about 1,1000 psia, 1,200 psia, 1,300 psia, etc.) as described above with respect to FIG. 1. Nitrogen or air can be used in this cycle as long as the gas is dry. The hydrocarbon content is monitored as known in the art to detect any leakages, and the unit can immediately shut down during emergency. The refrigeration cycle shown in FIG. 2 is similar to the refrigeration cycle shown in FIG. 1 except that the compressor unit 160 shown in FIG. 1 can comprise a two-stage compressor as shown in FIG. 2. Further, the compressor unit 150 that compresses a portion of the refrigerant stream can comprise a two-stage compression, where the two-stage compression can be mechanically coupled to the parallel expanders 170, 180 as shown in FIG. 1.

The gas pretreatment, vapor handling and the loading system are the same as in the previous design; the difference being the design of the liquefaction cycle. As shown in FIG. 1, feed gas is chilled and at least partially liquefied by the refrigeration cycle in the exchanger pass 152 to form a sub-cooled stream 103. As an example, the sub-cooled stream can be at about −238° F., which can then be let down in pressure in the JT valve 271 to form stream 204 that passes to the storage tank 265 as described above.

Within the refrigeration cycle, stream 226 from compressor 260, which can optionally be mechanically coupled to the expander 259, can be discharged, and optionally cooled in ambient cooler 212, prior to being combined with stream 132 to form the feed to the compressor unit. As an example, the stream 226 can be compressed to about 507 psia prior to being combined with stream 132. The compressor unit can comprise a two-stage refrigerant compressor unit comprising compressor 261 and compressor 262 with an intercooler 263. For example stream 120 can be compressed in compressor 261, the compressed stream 22 can pass to the intercooler 263, and the cooled, compressed stream 223 can then pass to the second-stage compressor 262. The compressor unit can compress the refrigerant to a high pressure above 1,000 psi, or another of the other pressures disclosed herein. The compressed refrigerant stream 128 can be cooled in an ambient cooler 164 to form stream 129. The ambient cooler 164 can comprise any suitable heat exchanger to cool the compressed refrigerant such as an air exchanger, water exchanger, or the like.

Stream 129 can pass from the ambient cooler 164 to the cold box 151 and pass through heat exchanger pass 155 to cool the high pressure refrigerant stream and form stream 130. As an example, the refrigerant in stream 129 can be cooled to form stream 130 at about −30° F. Stream 130 can then be split into two portions including stream **130*a* and 130*b*. The molar ratio of the two streams can be divided into any suitable amounts (e.g., as disclosed with respect to FIG. 1), which can be based on the feed gas composition and/or the pressure. In some aspects, the two streams 130*a* and 130*b* can be split at any of the molar ratios described with respect to FIG. 1**.

Stream **130*a* can be expanded in expander 257 to form stream 179. The expander 257 can be the same or similar to the expander 170 described with respect to FIG. 1. The expander can expand stream 130***a* according to any of the pressure ranges described with respect to FIG. 1. As an example, stream 130*a* can be expanded from about 1282 psia to about 508 psia, which is a ratio of about 40%. The expansion of stream 130*a* in the expander 257 can result in the formation of stream 179, which can be passed back to the cold box 151 in heat exchanger pass 153. As an example, the expansion of stream 130*a* can result in stream 179 having a temperature of about −126° F. Stream 179 can be used to cool the feed gas stream 102 and the high-pressure nitrogen steam 129 in heat exchanger pass 153 to form stream 132. As an example, stream 132 can leave the cold box 151 at about 507 psia and about 94° F.

Stream 130*b* can be expanded in expander 259 to form stream 127. The expander 159 can be the same or similar to the expander 180 described with respect to FIG. 1. The expander 159 can expand stream 130*b* according to any of the pressure ranges described with respect to FIG. 1. Further, the relative pressure ratios of the two expanded streams to each other and relative to the high pressure stream can fall within any of the ranges described with respect to FIG. 1. As an example, stream 130*b* can be expanded from about 1282 psia to about 110 psia using expander 259, which results in stream 127 have a pressure that is about 8.5% of the pressure of stream 130*b*. The expansion can result in stream 127 having a lower temperature, for example, about −242° F. Stream 127 can then be used to cool the feed gas 102 and the high pressure refrigerant stream in heat exchanger pass 154. The low pressure stream 121 can then be compressed prior to being combined with stream 132. As shown in FIG. 2, the stream 121 can be compressed by compressor 258, pass through line 233, and be compressed by a second-stage compressor 260 to compress the portion of the refrigerant to a pressure at or above the pressure in stream 132. As compared to FIG. 1, the compression of the stream 121 can be carried out in a two-stage compression using compressors 258, 260 arranged in series. As an example of the compression conditions, stream 121 can be compressed in compressors 258, 260 to about 508 psia, so that the stream 121 can be combined with stream 132 to form stream 120 as the feed to the refrigerant compressors 261, 262.

Figure 3:
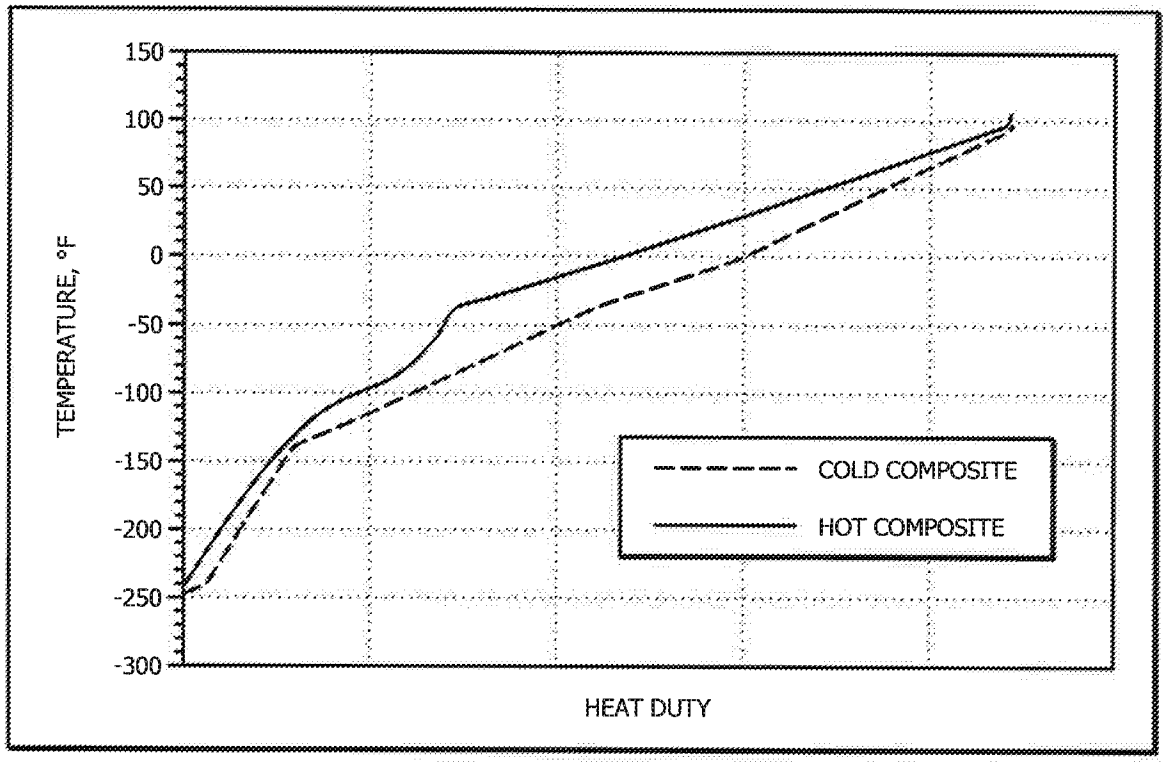
FIG. 3 is an exemplary graph illustrating the close temperature approach of the heat composite curves between the feed gas and the refrigeration circuit of FIG. 2.

As shown in FIG. 2, the expansion and compression cycles can be mechanically coupled. For example, the expanders used to expand streams 130*a* and 130*b* can be mechanically coupled to the compressors for the low-pressure stream 121 leaving heat exchanger pass 154. Specifically, the expander 257 can be mechanically coupled to compressor 258, and the expander 259 can be mechanically coupled to compressor 260. This type of configuration can be used to reduce the overall compression energy requirements. FIG. 3 illustrates a heat composite curve showing the temperature approaches between the feed gas and the refrigeration circuit according to the system described with respect to FIG. 2. This composite heat curve demonstrates the efficiency in achieving the natural gas liquefaction of the system described herein.

During conventional LNG truck loading operations, LNG is typically pumped using LNG pumps from the storage tank to the LNG trucks. This operation requires at least 2 hours' time, as the LNG truck must be chilled from typically ambient temperature to cryogenic temperature. This operation also generates a significant amount of boil-off vapors, which are in most cases vented to atmosphere and so present a substantial environmental concern.

In contrast, and as is shown in FIG. 2, LNG can be transferred from the LNG storage tank 265 to LNG transport 267 via streams 205, 206 and loading hose 266 by pressure differential, thereby allowing filling operation without the use of an LNG pump. LNG can be transferred from a top outlet nozzle 298 using an internal pipe 299 inside the storage tank 265. This configuration helps avoid any bottom nozzles from the storage tank 265, thereby avoiding spillage of the storage tank inventory typically encountered in conventional storage tank design. Consequently, LNG pumps are not required. Flow controller 282 can be adjusted as necessary to deliver the flow quantity to the LNG transport 267. When the level in the storage tank 265 drops to a low level, the level control 297 can reduce or stop flow in stream 205 at a predetermined low level. The LNG storage tank 265 can be configured with a capacity of between about 10,000 gallons and about 50,000 gallons, or about 30,000 gallons, which is sufficient to load at least two LNG transports 267, such as LNG trucks, each with 10,000 gallons capacity. During LNG truck loading operation, the valve 270 is closed, and the valve 269 is open, allowing boil-off vapor stream 207 to be vented from the LNG transport 267 to the cold box 151 as stream 209. Valve 269 can control the LNG transport vapor header at about 50 psig using the pressure controller 281, the lower pressure set-point of the LNG transport 267. With these valves operating in tandem, the boil-off vapors during loading are recovered, and venting to atmosphere is avoided. In some embodiments, the boil-off vapors can be at a lower temperature than the streams in the cold box 151, and routing these boil-off vapors back to the cold box 151 can allow the refrigerant content of the boil-off vapors to be recovered in the cold box 151.

In order to provide the driving force to pressurize the LNG inventory within the storage tank 265 and pass the LNG from the storage tank 265 to the LNG transport 267, valve 284 can be opened to provide high pressure gas in stream 285 to the storage tank 265. A pressure differential controller 288 and a pressure controller 283 can be used to control the flow rate of the LNG to the LNG transport 267. Typically, the pressure differential can be set at about 10 psi or higher, depending on the distance between the storage tank 265 and the LNG transport 267. The LNG loading rate can be varied from about 250 GPM to about 500 GPM using the flow controller 282. In general, the differential pressure can be increased to increase the loading rate. Therefore, it should be appreciated that LNG pumping is not necessary, and the loading system size and cost can be significantly reduced.

While contemplated methods and plants presented herein may have any capacity, it should be appreciated that such plants and methods are especially suitable for a small to mid-scale LNG plant having capacity of typically between 0.2 to 0.7 mtpy (million tonnes per year), more typically between 0.7 to 1.5 mtpy, and most typically between 1.5 to 2.5 mtpy of LNG production by liquefaction of appropriate quantities of feed gas. Consequently, contemplated plants and methods may be implemented at any location where substantial quantities of natural gas are available, and especially preferred locations include gas producing wells, gasification plants (e.g., coal and other carbonaceous materials), and at decentralized locations using gas from a natural gas pipeline. Thus, it should be recognized that the feed gas composition may vary considerably, and that depending on the type of gas composition, one or more pre-treatment units may be required. For example, suitable pre-treatment units include dehydration units, acid gas removal units, etc.

It is further noted that use of a cold box with an inert gas is particularly preferred, especially where the liquefaction/filling station is in an urban environment. However, various other cryogenic devices are also deemed suitable, and alternative devices include those that use mixed hydrocarbon refrigerants. Moreover, and particularly where the storage tank has a somewhat larger capacity, it is contemplated that refrigeration content from the LNG may also be used to supplement refrigeration requirements.

With respect to the differential pressure controller (dPC), it is noted that the dPC is preferably implemented as a control device with a CPU, and may therefore be configured as a suitably-programmed personal computer or programmable logic controller. It is also generally preferred that the dPC is configured such that the dPC controls operation of control valves to thereby maintain a predetermined pressure differential between the storage tank and the tank in the LNG transport vessel using pressure sensors and valves as is well known in the art. For example, control may be achieved by regulating pressure and/or flow volume of compressed boil-off vapor from the compressor outlet en route to the storage tank, by regulating pressure and/or flow volume of boil-off vapor from the tank in the LNG transport vessel, and/or by regulating pressure and/or flow volume of LNG from the storage tank to the tank in the LNG transport vessel. Thus, in at least some embodiments, the differential pressure controller will be configured to allow liquefaction operation concurrent with filling operation of the LNG transporter. Therefore, feeding of the natural gas to the liquefaction unit is done in a continuous manner. However, discontinuous feeding and liquefaction is also contemplated.

It should be noted that contrary to most known configurations, at least a portion of the boil-off vapor from the storage tank and/or tank in the LNG transport vessel is not liquefied, but used as a motive fluid to move LNG from the storage tank to the tank in the LNG transport vessel. Consequently, the need for a LNG pump is eliminated. Moreover, it should be noted that the refrigeration content of the boil-off vapor from the tank in the LNG transport vessel can be employed to supplement refrigeration requirements in the cold box. Thus, the boil-off vapor is heated rather than cooled and reliquefied as known in most operations.

It is still further contemplated that the storage tank may be modified in a manner such that LNG for export from the storage tank is drawn from a lower portion of the storage tank (e.g., sump or other location, typically below the center of gravity of the tank) through the vapor space of the tank to the filling line/loading hose, thereby avoiding problems associated with filling ports at the lower portion of the storage tank. Most typically, the tank will include an internal fill pipe that terminates at an upper portion of the tank to so allow connecting the internal fill pipe to a filling line/loading hose.

Having described the systems and methods herein, various aspects can include, but are not limited to:

In a first aspect, an LNG plant comprises a cold box comprising a plurality of heat exchanger passes; and a refrigeration unit comprising a closed refrigeration cycle, wherein the cold box is fluidly coupled with the refrigeration unit, wherein the cold box is configured to receive a natural gas feed stream and produce LNG from the feed stream using a refrigeration content from the refrigeration unit, wherein the refrigeration unit comprises: a first compressor unit configured to compress a refrigerant to produce a compressed refrigerant at a first pressure; a first heat exchanger pass of the plurality of heat exchanger passes, wherein the first heat exchanger pass is configured to pass the compressed refrigerant through the cold box to cool the compressed refrigerant; a splitter configured to separate the cooled, compressed refrigerant into a first portion and a second portion; a first expander configured to receive the first portion from the splitter and expand the first portion to a second pressure, wherein the second pressure is less than the first pressure; a second expander configured to receive the second portion from the splitter and expand the second portion to a third pressure, wherein the third pressure is less than the second pressure; a second heat exchanger pass of the plurality of heat exchanger passes configured to pass the first portion at the second pressure through the cold box; a third heat exchanger pass of the plurality of heat exchanger passes configured to pass the second portion at the third pressure through the cold box to provide at least a portion of the refrigeration content in the cold box; at least one second compressor, wherein the at least one second compressor is configured to receive the second portion downstream of the third heat exchanger pass and compress the second portion to the second pressure; and a mixer, wherein the mixer is configured to combine the compressed second portion downstream of the at least one second compressor and the first portion downstream of the second heat exchanger pass to form the refrigerant upstream of the first compressor.

A second aspect can include the LNG plant of the first aspect, wherein the first compressor unit comprises a plurality of compressors arranged in series and an intercooler disposed between consecutive compressors.

A third aspect can include the LNG plant of the first or second aspects, wherein the at least one second compressor comprises a plurality of second compressors, and wherein at least one second compressor of the plurality of second compressors is mechanically coupled to the first expander or the second expander.

A fourth aspect can include the LNG plant of any of the first to third aspects, wherein the second pressure is between about 20% and about 50% of the first pressure on an absolute scale.

A fifth aspect can include the LNG plant of any of the first to fourth aspects, wherein the third pressure is between about 3% and about 20% of the first pressure on an absolute scale.

A sixth aspect can include the LNG plant of any of the first to fifth aspects, further comprising a heat exchanger fluidly coupled between the first compressor and the first heat exchanger pass, wherein the heat exchanger is configured to cool the compressed refrigerant prior to the compressed refrigerant passing to the first heat exchanger pass.

In a seventh aspect, an LNG plant comprises a cold box comprising a heat exchanger, wherein the heat exchanger comprises a plurality of heat exchanger passes; a refrigeration unit fluidly coupled with the plurality of heat exchanger passes, wherein the refrigeration unit is configured to provide: a first refrigerant stream to a first heat exchanger pass of the plurality of heat exchanger passes, wherein the first refrigerant stream is at a first pressure; a second refrigerant stream to a second heat exchanger pass of the plurality of heat exchanger passes, wherein the second refrigerant stream comprises a first portion of the first refrigerant stream downstream of the first heat exchanger pass, and wherein the second refrigerant stream is at a second pressure; and a third refrigerant stream to a third heat exchanger pass of the plurality of heat exchanger passes, wherein the third refrigerant stream comprises a second portion of the first refrigerant stream downstream of the first heat exchanger pass, and wherein the third refrigerant stream is at a third pressure, wherein the second pressure and the third pressure are both below the first pressure; wherein the cold box is configured to receive a natural gas feed stream and produce LNG from the natural gas feed stream using a refrigeration content from the refrigeration unit in the plurality of heat exchanger passes.

An eighth aspect can include the LNG plant of the seventh aspect, wherein the first pressure is between about 1,000 psia and 2,000 psia.

A ninth aspect can include the LNG plant of the seventh or eighth aspect, wherein the second pressure is between about 20% and about 50% of the first pressure on an absolute scale.

A tenth aspect can include the LNG plant of any of the seventh to ninth aspects, wherein the third pressure is between about 3% and about 20% of the first pressure on an absolute scale.

An eleventh aspect can include the LNG plant of any of the seventh to tenth aspects, wherein a ratio of the second pressure to the third pressure is between about 10:1 and about 2:1.

A twelfth aspect can include the LNG plant of any of the seventh to eleventh aspects, wherein a molar ratio of a flowrate of the second refrigerant stream to a flowrate of the first refrigerant stream is between about 0.5 and about 0.75.

A thirteenth aspect can include the LNG plant of any of the seventh to twelfth aspects, wherein the refrigeration unit is configured to provide the LNG at an energy of between about 320 kW/ton and about 425 kW/ton.

In a fourteenth aspect, a method of generating LNG from a natural gas feed comprises passing a first refrigerant stream through a first heat exchanger pass of a plurality of heat exchanger passes in a cold box, wherein the first refrigerant stream is at a first pressure; separating the first refrigerant stream into a second refrigerant stream and a third refrigerant stream downstream of the cold box; passing the second refrigerant stream through a second heat exchanger pass of the plurality of heat exchanger passes, wherein the second refrigerant stream is at a second pressure; passing the third refrigerant stream through a third heat exchanger pass of the plurality of heat exchanger passes, wherein the third refrigerant stream is at a third pressure, wherein the second pressure and the third pressure are both below the first pressure; passing a natural gas feed stream through at least a fourth heat exchanger pass of the plurality of heat exchanger passes; and liquefying at least a portion of the natural gas stream in the cold box using a refrigeration content provided by at least one of the second refrigerant stream or the third refrigerant stream to form an LNG stream.

A fifteenth aspect can include the method of the fourteenth aspect, further comprising combining the second refrigerant stream and the third refrigerant stream downstream of the cold box to form a recycle stream; and compressing the recycle stream to form the first refrigerant stream.

A sixteenth aspect can include the method of the fifteenth aspect, wherein compressing the recycle stream comprises compressing the recycle stream in a two-stage compressor.

A seventeenth aspect can include the method of the fifteenth or sixteenth aspect, further comprising expanding the second refrigerant stream to the second pressure in a first expander; expanding the third refrigerant stream to the third pressure in a second expander, wherein the second pressure is between about 20% and about 50% of the first pressure on an absolute scale; and compressing the third refrigerant stream prior to combining the second refrigerant stream and the third refrigerant stream.

An eighteenth aspect can include the method of the seventeenth aspect, wherein at least one of the first expander or the second expander is coupled to a compressor, wherein compressing the third refrigerant stream prior to combining the second refrigerant stream and the third refrigerant stream comprises using the compressor to compress the third refrigeration stream.

A nineteenth aspect can include the method of any of the fourteenth to eighteenth aspects, wherein the second pressure is between about 20% and about 50% of the first pressure on an absolute scale.

A twentieth aspect can include the method of any of the fourteenth to nineteenth aspects, wherein the third pressure is between about 3% and about 20% of the first pressure on an absolute scale.

Thus, specific embodiments and applications of small scale LNG production and filling have been disclosed. It should be apparent to those skilled in the art that many more modifications besides those already described are possible without departing from the concepts described herein. The present subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, utilized, or combined with other elements, components, or steps that are not expressly referenced. Where the specification or claims refers to at least one of something selected from the group consisting of A, B, C . . . and N, the text should be interpreted as requiring only one element from the group, not A plus N, or B plus N, etc.

What is claimed is:

1. A method of generating LNG from a natural gas feed comprising:

passing a first refrigerant stream through a first heat exchanger pass of a plurality of heat exchanger passes in a cold box, wherein the first refrigerant stream is at a first pressure;

splitting the first refrigerant stream into a second refrigerant stream and a third refrigerant stream by passing the first refrigerant stream through a splitter downstream of the cold box;

expanding the second refrigerant stream to a second pressure in a first expander;

after expanding the second refrigerant stream, passing the second refrigerant stream through a second heat exchanger pass of the plurality of heat exchanger passes at the second pressure;

expanding the third refrigerant stream to a third pressure in a second expander;

after expanding the third refrigerant stream, passing the third refrigerant stream through a third heat exchanger pass of the plurality of heat exchanger passes at the third pressure, wherein the second pressure and the third pressure are both below the first pressure;

after passing the third refrigerant stream through the third heat exchanger pass, compressing, by a first compressor and then by a second compressor, the third refrigerant stream to a fourth pressure equal to or above the second pressure;

after compressing the third refrigerant stream, cooling the third refrigerant stream;

after cooling the third refrigerant stream, combining the second refrigerant stream and the third refrigerant stream downstream of the cold box to form a recycle stream;

compressing the recycle stream in a two-stage compressor to form the first refrigerant stream;

passing a natural gas feed stream through at least a fourth heat exchanger pass of the plurality of heat exchanger passes; and liquefying at least a portion of the natural gas stream in the cold box using a refrigeration content provided by at least one of the second refrigerant stream and the third refrigerant stream to form an LNG stream, wherein the first expander is disposed downstream from the splitter, wherein the first expander is coupled to the first compressor, wherein the second expander is coupled to the second compressor.

2. The method of claim 1, wherein combining the second refrigerant stream and the third refrigerant stream comprises combining the second refrigerant stream at the second pressure and the third refrigerant stream at the fourth pressure.

3. The method of claim 1, wherein the first expander is coupled to the first compressor, wherein the second expander is coupled to the second compressor.

4. The method of claim 1, wherein each of the first refrigerant stream, the second refrigerant stream, and the third refrigerant stream consists of one or more non-hydrocarbon refrigerants.

5. The method of claim 1, wherein the second pressure is between 20% and 50% of the first pressure on an absolute scale, and wherein the third pressure is between 3% and 20% of the first pressure on an absolute scale.

6. The method of claim 1, wherein the first pressure is between 1,000 psia and 2,000 psia.

7. The method of claim 1, wherein a ratio of the second pressure to the third pressure is between 10:1 and 2:1.

8. The method of claim 1, wherein a molar ratio of a flowrate of the second refrigerant stream to a flowrate of the first refrigerant stream is between 0.5 and 0.75.

9. The method of claim 1, further comprising:

passing a boil-off gas received from a LNG transport through a fifth heat exchanger pass of the plurality of heat exchanger passes;

recovering refrigeration content from the boil-off gas in the cold box to form a heated boil-off gas.

10. The method of claim 9, further comprising:

compressing the heated boil-off gas; and combining a portion of the compressed heated boil-off gas with the natural gas stream.

11. The method of claim 9, further comprising:

compressing the heated boil-off gas; and passing a portion of the compressed heated boil-off gas to a LNG storage tank.

12. The method of claim 11, further comprising:

moving, by the compressed heated boil-off gas, LNG from the storage tank to a LNG transport.

* * * * *